US010683766B2

(12) United States Patent
Lang et al.

(10) Patent No.: US 10,683,766 B2
(45) Date of Patent: Jun. 16, 2020

(54) STATIC WEAR SEALS FOR A COMBUSTOR TRANSITION

(71) Applicant: Siemens Energy, Inc., Orlando, FL (US)

(72) Inventors: Matthew H. Lang, Orlando, FL (US); James M. Hurney, Port Orange, FL (US); Charalambos Polyzopoulos, Orlando, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 383 days.

(21) Appl. No.: 15/223,529

(22) Filed: Jul. 29, 2016

(65) Prior Publication Data

US 2018/0030841 A1 Feb. 1, 2018

(51) Int. Cl.
*F01D 9/02* (2006.01)
*F01D 11/00* (2006.01)

(52) U.S. Cl.
CPC ..... *F01D 9/023* (2013.01); *F01D 11/005* (2013.01); *F05D 2220/32* (2013.01); *F05D 2240/35* (2013.01); *F05D 2240/55* (2013.01); *F23R 2900/00012* (2013.01)

(58) Field of Classification Search
CPC ..... F01D 11/005; F01D 9/023; F23R 2900/00012; F05D 2240/55
See application file for complete search history.

(56) References Cited

U.S. PATENT DOCUMENTS 3,965,066 A * 6/1976 Sterman ..... F01D 9/023 60/800
4,232,527 A * 11/1980 Reider ..... F23R 3/08 60/754
5,749,218 A * 5/1998 Cromer ..... B23P 6/002 60/39.37
6,588,214 B2 * 7/2003 Mack ..... F01D 9/023 60/798
7,527,469 B2 * 5/2009 Zborovsky ..... F01D 9/041 277/412
8,092,159 B2 * 1/2012 Maldonado ..... F01D 5/186 29/889.721

(Continued)

FOREIGN PATENT DOCUMENTS

JP 2003193866 A * 7/2003

OTHER PUBLICATIONS

JP-2003193866 Machine Translation.*

*Primary Examiner* — Nicholas L Foster

(57) ABSTRACT

A static wear seal for an interface between two components is provided. The static wear seal includes a body portion including a receptacle configured to receive an insert portion. The insert portion is disposed within the receptacle. The receptacle is formed within the body portion at a surface of the body portion known to wear due to contact with a turbine component and includes a locking means such that the insert portion is retained within the receptacle. The insert portion is configured to receive wear due to contact with the turbine component. A transition seal assembly for a gas turbine engine including at least two seals wherein one of the two seals is a static wear seal is provided as well as a method to protect a wear surface of a static wear seal sealing an interface between the turbine components.

6 Claims, 4 Drawing Sheets

(56) References Cited

U.S. PATENT DOCUMENTS

| | | | | |
|---|---|---|---|---|
| 8,491,259 | B2 * | 7/2013 | Sutcu | F01D 9/023 415/134 |
| 2003/0066292 | A1 * | 4/2003 | Mack | F01D 9/023 60/752 |
| 2006/0123797 | A1 * | 6/2006 | Zborovsky | F01D 9/041 60/800 |
| 2010/0247286 | A1 * | 9/2010 | Maldonado | F01D 5/186 415/1 |

* cited by examiner

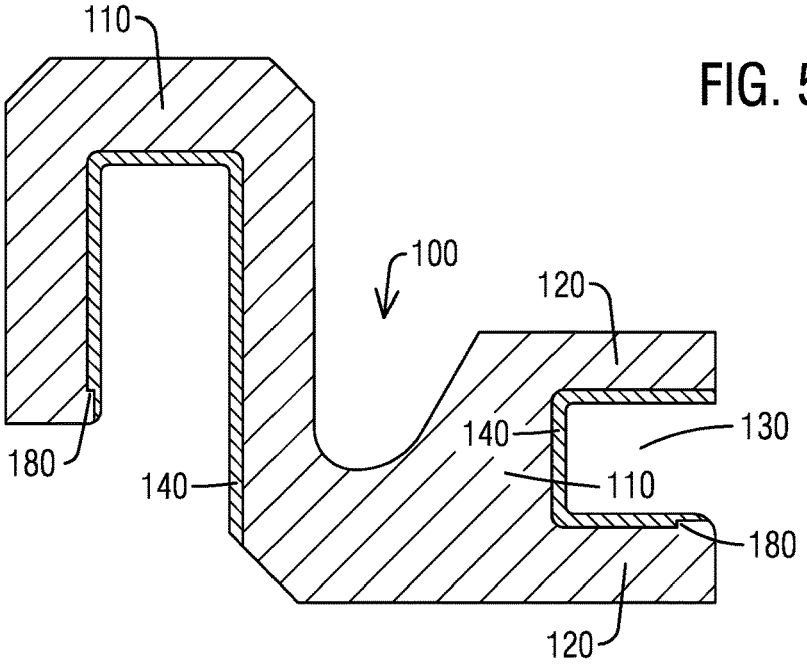
FIG. 5
FIG. 6
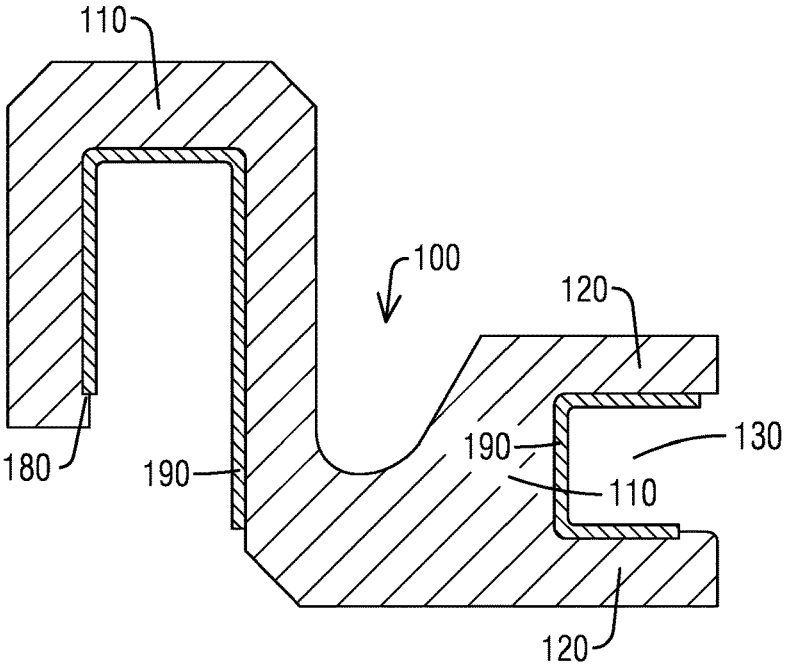
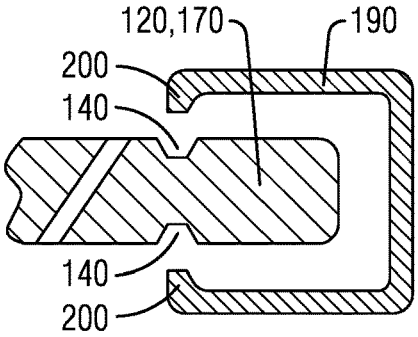
FIG. 7

STATIC WEAR SEALS FOR A COMBUSTOR TRANSITION

BACKGROUND

The present application is generally related to gas turbines and components that provide an interface between the combustion section and the inlet of the turbine section of a gas turbine. More specifically, the present application relates to a static wear seal for an interface between two turbine components.

DESCRIPTION OF THE RELATED ART

A typical gas turbine includes multiple combustion chambers in a circumferential configuration about the engine shaft. For each combustion chamber there is normally a transition duct, also referred to as a transition piece, through which the hot combustion exhaust flow is carried from each combustion chamber to the inlet of the turbine section. With the plurality of combustion chambers arranged about a central axis of the gas turbine engine, the transition pieces are radially arranged about the turbine axis and comprise outlet ends that converge to form an annular inflow to the turbine inlet. Each transition piece is joined via a sealing arrangement to the turbine inlet section, which is at the front end of the row one vane segment.

The seals that comprise the sealing arrangement and adjoining components experience thermal expansion, thermal stresses, and vibrational forces resulting from combustion dynamics. Consequently, due to contact with adjoining components during the operation of the gas turbine, surfaces of the seals experience sufficient wear that so that the sealing between the turbine components cannot be maintained.

Currently, the seals that experience high levels of wear require replacement or repair. The current repair solution for these seals is to weld, braze, and machine the sealing component. Processes such as these require heating the seals to high temperatures which may alter the material properties. As one skilled in the art may appreciate, when brazing components, cleanliness of the components is a concern. In addition, current repair techniques use the same material for the repair as the primary component with the result that it is not possible to augment the wear function and minimize the loss of material between components. Repairing seals with excessive wear is time consuming and results in higher costs to operate the gas turbine. An even more undesirable option would be replacing every worn seal as there are many such seals used within the gas turbine and the cost associated with replacing each of them would be high.

SUMMARY

Briefly described, aspects of the present disclosure relate to a static wear seal for an interface between two turbine components, a transition seal assembly, and a method to protect a wear surface of a static wear seal sealing an interface between turbine components that experience wear due to contact.

A static wear seal for an interface between two turbine components is provided. The static wear seal includes a body portion including a receptacle. The receptacle is configured to receive an insert. The insert fits inside the receptacle. The receptacle is formed within the body portion starting at a surface of the body portion that is known to wear due to contact with a turbine component. The receptacle includes a locking mechanism such that the insert is locked within the receptacle. The insert portion is configured to receive wear due to contact with the turbine component.

A transition seal assembly for a gas turbine engine, along which exhaust gas generated in a combustion chamber flows toward a turbine of the engine, is provided. The transition seal assembly includes a first seal and a second seal. The first seal includes a body portion with a receptacle formed within the body portion at a first surface. The second seal includes a second surface that contacts the first surface. An insert is disposed within the receptacle and is configured to receive wear due to contact with the surface of the second seal. The receptacle is configured to receive the wear due to the contact with the surface of the second seal.

A method to protect a wear surface of a static wear seal sealing an interface between turbine components that experience wear due to contact is provided. The method includes identifying a wear surface of the static wear seal that experiences wear due to contact with a turbine component. The identified wear surface is then machined to create a receptacle configured to receive an insert portion. An insert portion comprising a sacrificial material is inserted into the receptacle such that the sacrificial material wears due to contact with the turbine component. The insert portion is locked within the receptacle such that the insert portion is retained within the receptacle. The receptacle includes a stepped profile and the insert portion includes a surface corresponding to the stepped profile of the receptacle such that when inserted the stepped profile engages the surface.

BRIEF DESCRIPTION OF THE DRAWINGS

FIG. 5 illustrates a floating seal with two receptacles, FIG. 6 illustrates a floating seal with two inserts disposed in the two receptacles, and FIG. 7 illustrates a transition seal assembly.

DETAILED DESCRIPTION

To facilitate an understanding of embodiments, principles, and features of the present disclosure, they are explained hereinafter with reference to implementation in illustrative embodiments. Embodiments of the present disclosure, however, are not limited to use in the described systems or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

In referencing features and orientations of components shown in the figures, the term radial is used with respect to a central axis, A, about which a rotating machine turns. Even though the component may be illustrated in a figure separate and apart from the rotating machine, it is to be understood that references to positioning, e.g., 'radially inner' or 'radially outer' correspond to relative positioning as though the component is installed.

Figure 1:
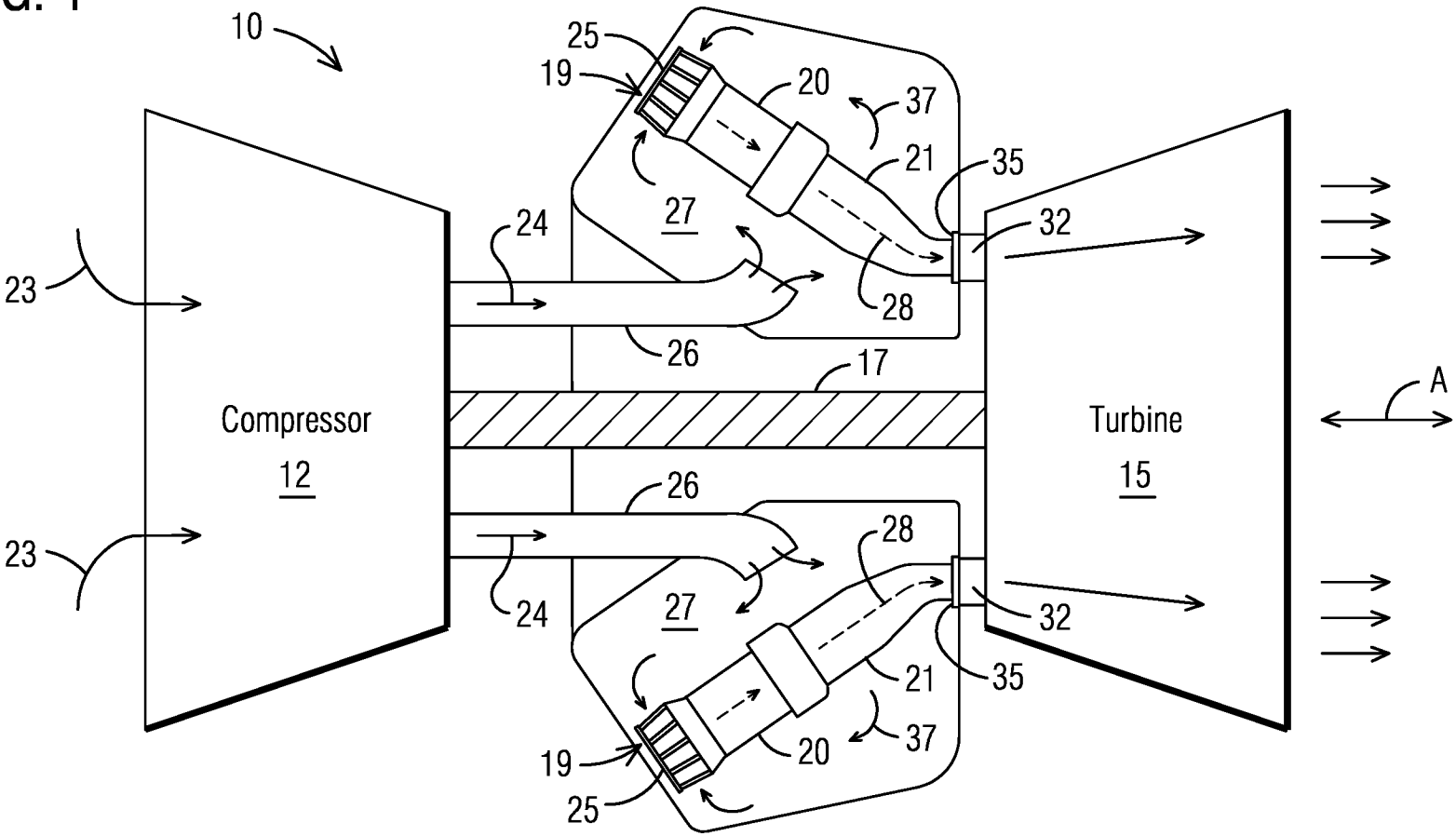
FIG. 1 illustrates a schematic view of a gas turbine engine.

FIG. 1 is a schematic view of an exemplary gas turbine engine 10 within which embodiments of the invention may be incorporated. The gas turbine engine 10 includes a compressor 12, several combustor assemblies arranged in a circular array in a can-annular design, a turbine section 15, and an engine shaft 17 by which the turbine 15 drives the compressor 12. The combustor assemblies each comprise fuel injectors (not shown) within a cap assembly 19, combustion chambers 20 and transition pieces 21. During operation, the compressor 12 intakes air 23 and provides a flow 24 of compressed air to combustor inlets 25 via a diffuser 26 and a combustor plenum 27. The fuel injectors within the cap assembly 19 mix fuel with the compressed air flow 24. This mixture burns in the combustion chamber 20 producing hot combustion gas, referred to as the working gas 28, that passes through the transition piece 21 to the turbine 15 via a sealed connection comprising inner and outer sealing interfaces. The sealing interfaces are positioned between an exit frame 35 of the transition piece 21 and an inlet section 32 of the turbine 15. The diffuser 26 and the plenum 27 may extend annularly about the engine shaft 17. The compressed air flow 24 entering each combustor plenum 27 has higher pressure than the working gas 28 in the associated combustion chamber 20 and in the transition piece 21.

Figure 2:
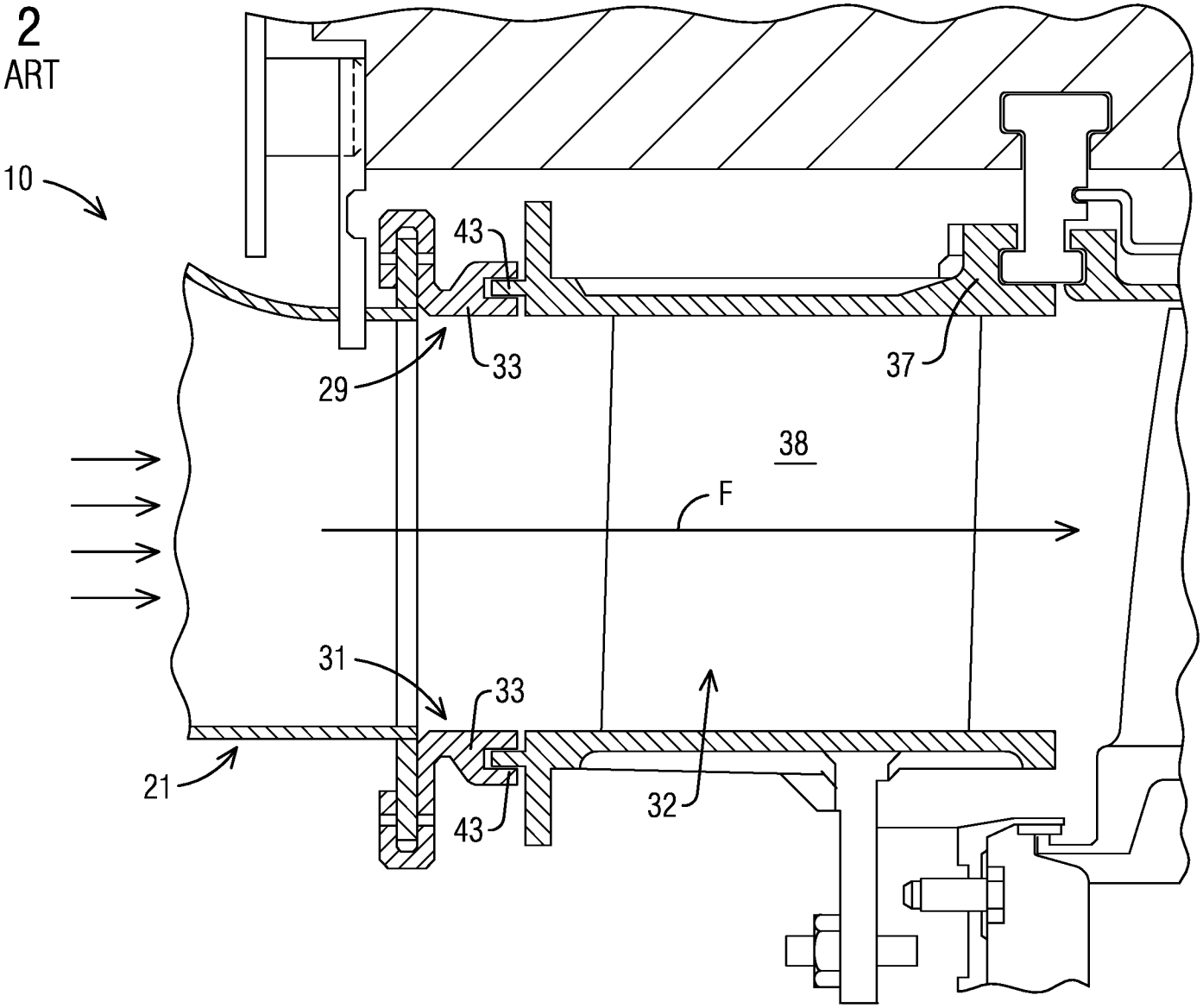
FIG. 2 PRIOR ART
FIG. 2 illustrates a partial cross-sectional view of the gas turbine engine.

FIG. 2 provides a partial cross-sectional view of the gas turbine engine 10 for an embodiment in which a typical prior art design of the inner and outer sealing interface 29 and 31 is employed. Each sealing interface 29, 31 is positioned between a transition piece 21 and an inlet section 32 of the turbine 15. The inlet section 32 is upstream of the Row 1 vane segment 37 which includes exemplary airfoil 38. Relative to the axis, A, of rotation about which the engine shaft 17 rotates, the inner and outer sealing interfaces 29, 31 are referred to as such because the inner sealing interface 29 is a shorter distance from the outer sealing interface 31 to the axis, A. The flow path is designated by F.

Figure 3:
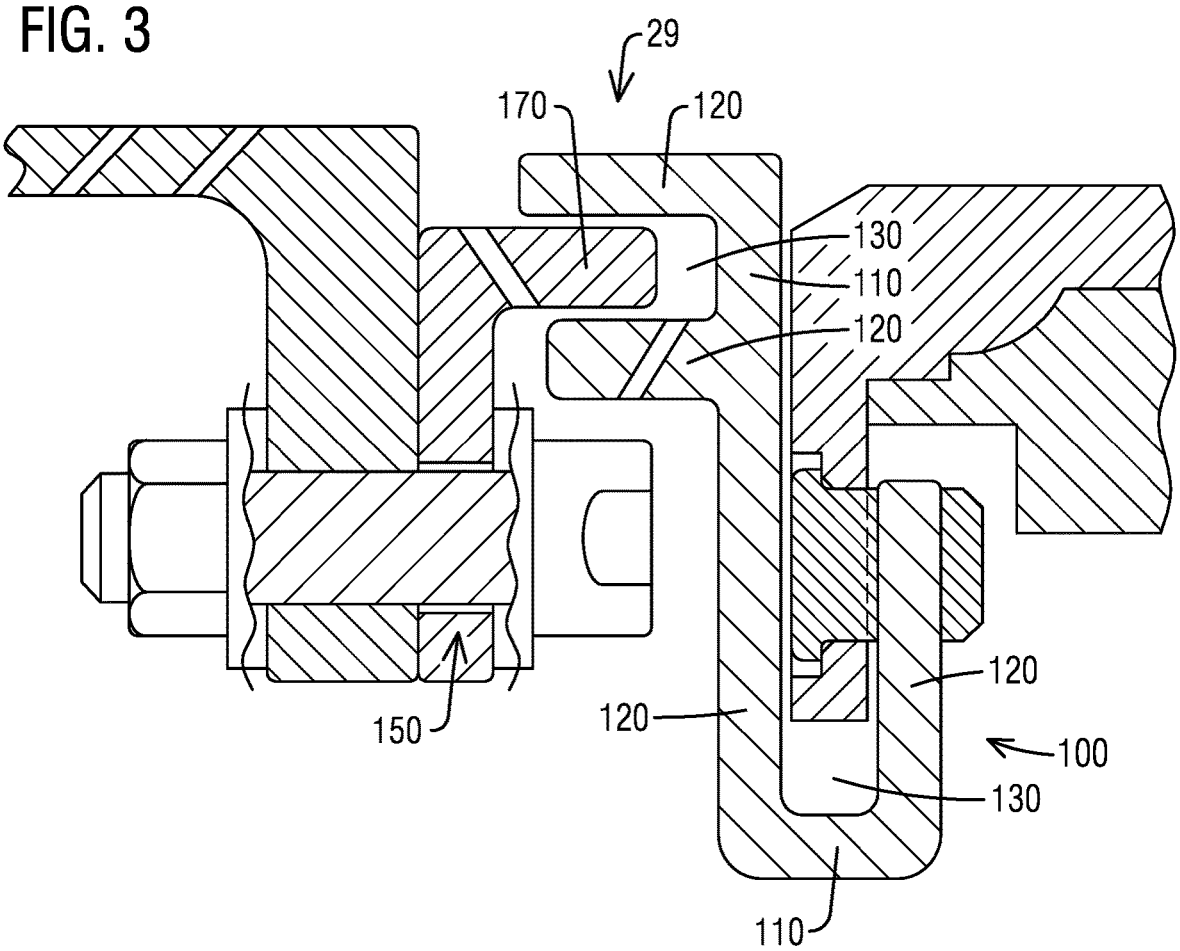
FIG. 3 illustrates a inner sealing assembly.

The inner and outer sealing interfaces 29, 31 may include an inner floating seal and an outer floating seal 33, respectively. Additionally, the inner and outer sealing interface 29, 31 may each include an L-seal 43. FIG. 3 shows an inner sealing interface 29 including an L-seal 150 and a floating seal 100. As seen in FIG. 2, the outer sealing interface 31 would include a similar configuration as the inner sealing interface 29 and lie radially outward from the inner sealing interface 29.

The floating seal 100 may include a body portion comprising U-shaped members. In the embodiment shown in FIG. 3, the floating seal 100 includes two U-shaped members 110. Each U-shaped members 110 includes two leg members 120 separated by a slot 130. In an embodiment, the slot 130 may accommodate and engage a leg member 170 of an L-seal 150 within the slot 130. In a further embodiment, the slot 130 may accommodate and engage a radially inner Row 1 vane rail of the inlet section 32 with the slot. Wear on the floating seal 100 occurs at the interface where its leg member 120 engages the opposing leg member 170 of the L-seal 150 or the vane rail due to the contact between the two opposing surfaces.

Figure 4:
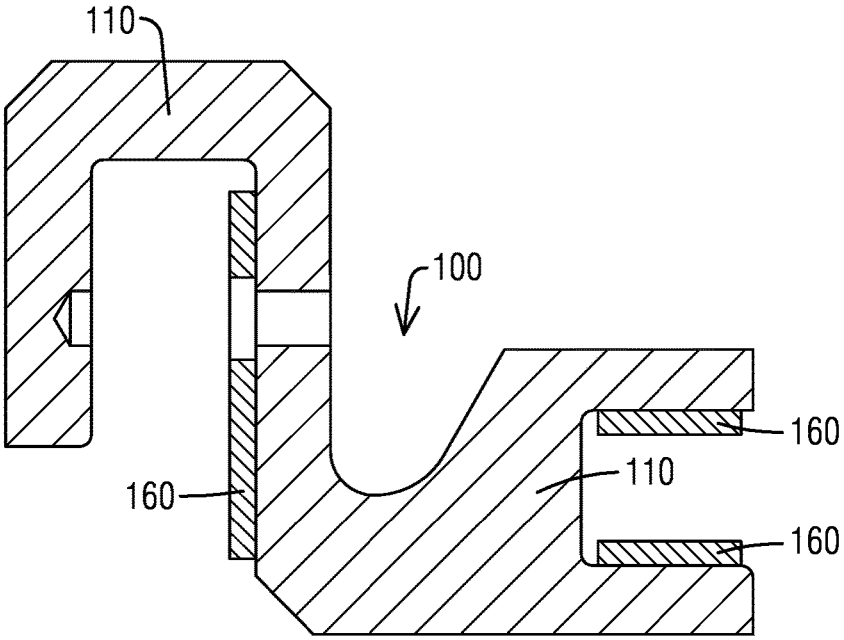
FIG. 4 illustrates a typical seal repair.

FIG. 4 illustrates a prior art typical repair of a floating seal 100. Wear strips 160 are attached to the interior surface of the leg members 110 where contact is made with an opposing member. However, this repair technique typically uses wear strips 160 that are brazed on requiring a lengthy high temperature process in a vacuum furnace. Additionally, wear strips 160 made of the same material as the floating seal 100 may lead to heavy repair of the floating seal. By changing the wear strip material, the dynamic wear between the wear strip 160 and the floating seal may be minimized.

In order to improve the transition sealing interfaces 29, 31 so that the seals 100, 150 can be easily repaired and not replaced, a static wear seal including replaceable inserts disposed in positions that endure excessive wear due to contact with other components is proposed. For example, an insert made of a sacrificial material may be easily removed from the remaining body portion of the seal and replaced reducing repair time and the cost of replacing the entire static wear seal.

FIG. 5 illustrates an embodiment of a static wear seal in the form of a floating seal 100. The illustrated floating seal 100 includes two U-shaped members 110, each U-shaped member comprising two legs 120 separated by a slot 130. One skilled in the art would understand that the sealing component may include many different configurations and shapes.

As discussed previously, due to the contact made with an opposing surface of a turbine component, a surface of the U-shaped member 110 may experience wear. At the locations known to experience wear, which in the present embodiment includes the interior surfaces of the U-shaped member 110, a receptacle 140 may be formed into the U-shaped member 110 at the interior surface in order to accommodate an insert portion. The receptacle 140 may include a shallow depth in a range of 0.75 mm to 10 mm. As may be seen in FIG. 5, at one end of the interior surface that forms the receptacle 140, the interior surface includes a stepped profile 180. The depth of the step may include a range of 0.5 mm to 6.0 mm.

FIG. 6 illustrates the embodiment of FIG. 5 with the insert portion 190 inserted into the receptacle 140 as seen in FIG. 5. The insert portion 190 may be inserted into the receptacle 140 by sliding the insert portion 190 into the receptacle 140 circumferentially. By the engagement of the stepped profile 180 with a corresponding surface of the insert portion 190, radial movement of the insert portion 190 is prevented. In this embodiment, axial movement of the insert portion 190 is prevented as the insert portion 190 is body bound by the U-shaped member 110.

In order to attach the insert portion 190 to the body portion 110 within the receptacle 140, a joining technique may be used. The joining technique may comprise spot welding and/or brazing. Additionally, a fastening means such as a pin inserted through both the body portion and insert portion may be used as well as an interference fit mechanism.

As illustrated, the insert portion 190 may comprise a U-shaped cross section. This configuration may be selected for ease of manufacturing the insert portion 190, however, the insert portion 190 may include other cross sections such as V-shaped, dove-tail, and L-shaped. The insert portion 190 may be formed with a die, machined, or by other conventional thin sheet techniques. The thickness of the insert portion 190 lies in the range of 0.5 mm to 10 mm. The insert portion 190 may fit within the receptacle 140 such that the insert portion 190 fills the receptacle 190.

A material of the insert portion 190 may include a material that is different from the material of the body portion 110. A material used for the insert portion 190 may include a cobalt-based material or other material that is more wear resistant than the material of the body portion 110. As the softer material is replaceable, the 'base' material of the body portion remains substantially wear-free.

In an alternate embodiment, the insert portion 190 may comprise a coating including a sacrificial material which may be sprayed into the receptacle 140 of the body portion 110 of the static wear seal 100, 150.

A transition seal assembly as exemplified by the inner sealing interface 29 shown in FIG. 3 includes an inner floating seal 100 and a bolted L-seal 150. In the embodiment shown in FIG. 3, the floating seal 100 includes two U-shaped body members 110 separated by a slot 130, the slot 130 accommodating and engaging a leg member 170 of an L-seal 150 within the slot 130. Wear on the floating seal 100 occurs at the interface where its leg member 120 engages the opposing leg member 170 of the L-seal 150 due to the contact between the two opposing surfaces. Insert portions 190 may be disposed in respective receptacles 140 in the body portions of the respective seals where the contact between the two opposing surfaces is made. Each receptacle 140 includes a locking means so that the insert portion 190 is retained within the body portion 110 of the seal. During the operation of the gas turbine, the insert portion 190 of each respective seal will receive the wear due to the contact with opposing insert portion 190.

As discussed previously, the locking means of the static wear seal may include the engagement of a surface of the body portion comprising a stepped portion 180 with a corresponding surface of the insert portion 190. A joining technique to attach the insert portion 190 to the body portion 110 as described above may also be used.

In another embodiment, the insert portion 190 may comprise a cap 190 that surrounds an end portion of a leg 120, 170 of the seal as shown in FIG. 7. The cap 190 includes at least one protruding portion 200 that is disposed within the receptacle 140 of the end portion of the leg 120, 170 such that a surface of the protruding portion 200 abuts a corresponding surface of the receptacle 140. The at least one protruding portion 200 of the cap 190 may slide circumferentially into the receptacle 140. A joining means as described above, for example spot welding, may be used to attach the protruding portion 200 of the cap 190 to the leg 120, 170 of the seal.

Referring to FIGS. 1-7, a method to protect a wear surface of a static wear seal sealing an interface between turbine components that experiences wear due to contact is also provided. The method includes identifying a wear surface of the static wear seal where significant wear is known to occur due to wear with another turbine component. Due to experience with these static wear seals in the field, service personnel are familiar with the wear patterns on the seals. At the locations on the seals where the wear has been known to occur, the wear surface may be machined to create a receptacle 140 configured to receive an insert portion 190.

Once the receptacle 140 has been machined, an insert portion 190 as described previously may be inserted into the receptacle 140. The insert portion 190 may comprise a material different than the material of the body portion of the seal. For example the material of the insert portion 190 may be softer than the material of the body portion of the seal. The material of the insert portion 190 thus becomes a sacrificial material taking most if not all of the wear due to contact with an opposing turbine component.

A mechanical interface may function to lock the insert portion 190 into place such that the insert portion 190 is retained in the receptacle 140. For example, the body portion 110, 150 of the seal may include a stepped profile 180 corresponding to a surface of the insert portion 190. When the stepped profile 180 and the corresponding surface of the insert portion 190 are engaged, or abut one another, radial movement of the insert portion 190 is prevented. A joining technique such as brazing or spot welding may be used to attach the insert portion 190 to the body portion 110, 150 of the static wear seal.

In an embodiment, especially when the static wear seal is worn and needs to be replaced, the insert portion 190 may be easily removed by removing the spot welds and/or the braze material. The method may be used to replace the worn insert portion with a new insert portion 190.

The disclosed static wear seal, transition sealing assembly and method may be used to quickly and cost-effectively replace sections of a seal that experience wear without replacing the entire seal. The material of the insert portion is chosen to be sacrificial such that it wears instead of the material of the body portion of the seal so that the usable life of the seal is lengthened. In one embodiment, the sacrificial material may comprise a coating that is simply sprayed into the receptacle. Using fairly simple measures such as a mechanical interface including the engagement of the corresponding surfaces of the body portion and the insert portion in addition to spot welding the insert portion to attach it to the body portion, the insert portion may be retained in the receptacle. The insert portion may be quickly removed and replaced during a routine service outage of the gas turbine.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A static wear seal for an interface between two turbine components, comprising:

a U-shaped body portion including a receptacle configured to receive an insert portion, the insert portion disposed within the receptacle;

wherein the receptacle is formed within the body portion at a first surface of the body portion capable of wear due to contact with one of the turbine components, wherein the first surface comprises an interior surface of the U-shaped body portion, and wherein the insert portion is configured to receive wear due to the contact with the one of the turbine components, wherein the first surface includes a stepped profile, wherein the first surface engages a corresponding second surface of the insert portion, the second surface having a corresponding stepped profile to the stepped profile of the first surface, and wherein the corresponding stepped profile of the second surface interfits with stepped profile of the first surface to prevent radial and axial movement of the insert portion.

2. The static wear seal as claimed in claim 1, wherein a material of the insert portion is different than a material of the body portion.

3. The static wear seal as claimed in claim 2, wherein the material of the insert portion is a cobalt-based material.

4. The static wear seal as claimed in claim 1, wherein the insert portion is a coating.

5. A transition seal assembly for a gas turbine engine, along which exhaust gas generated in a combustion chamber flows toward a turbine of the gas turbine engine, comprising:

a first seal including a U-shaped body portion with a receptacle formed within the body portion at a first surface;

a second seal including a second surface that contacts the first seal; and an insert portion disposed within the receptacle, wherein the first surface comprises an interior surface of the U-shaped body portion, wherein the insert portion is configured to receive wear due to contact with the surface of the second seal, wherein the first surface includes a stepped profile, wherein the second surface includes a corresponding stepped profile that interfits with the stepped profile of the first surface, and wherein engagement of the first surface with the second surface prevents radial and axial movement of the insert portion.

6. The transition seal assembly as claimed in claim 5, wherein the body portion comprises an L-shaped body member including one leg member.

* * * * *